United States Patent [19]

Pandeya et al.

[11] Patent Number: 4,577,472

[45] Date of Patent: Mar. 25, 1986

[54] REVERSIBLE ROTATING VANE ROTARY COMPRESSOR HAVING A MOVABLE SUPPLEMENTAL SUCTION PORT

[75] Inventors: Prakash N. Pandeya, Clay; Tsuwei Chu, Liverpool, both of N.Y.

[73] Assignee: Carrier Corporation, Syracuse, N.Y.

[21] Appl. No.: 705,294

[22] Filed: Feb. 25, 1985

[51] Int. Cl.[4] ..... F25B 13/00; F01C 21/12; F04B 35/04

[52] U.S. Cl. ..... 62/324.6; 62/160; 418/15; 418/159; 417/902

[58] Field of Search ..... 418/15, 159; 417/326, 417/410, 442, 503, 902; 62/160, 324.1, 324.6, 508

[56] References Cited

U.S. PATENT DOCUMENTS

| | | | |
|---|---|---|---|
| 2,306,632 | 12/1942 | McCormack | 62/508 X |
| 2,342,174 | 2/1944 | Wolfert | 62/160 |
| 2,343,514 | 3/1944 | McCormack | 62/160 X |
| 2,844,945 | 7/1958 | Muffly | 62/160 |
| 2,976,698 | 3/1961 | Muffly | 62/160 |
| 3,723,024 | 3/1973 | Sawai et al. | 418/159 |
| 3,985,473 | 10/1976 | King et al. | 418/248 X |
| 4,367,638 | 1/1983 | Gray | 418/15 X |
| 4,445,344 | 5/1984 | Ladusaw | 62/324.6 |

FOREIGN PATENT DOCUMENTS

| | | | |
|---|---|---|---|
| 21610 | 2/1979 | Japan | 418/15 |
| 973930 | 11/1982 | U.S.S.R. | 418/15 |

*Primary Examiner*—William L. Freeh
*Assistant Examiner*—Paul F. Neils
*Attorney, Agent, or Firm*—David J. Zobkiw

[57] ABSTRACT

A fluid pressure responsive member is shifted in accordance with the pressure differential between two lines either one of which can be a suction line with the other line being a discharge line of a reversible compressor. The fluid pressure responsive member has an arcuate recess formed therein which serves as a secondary suction port which provides fluid communication to the offset cylindrical chamber from the suction line in accordance with the position of the fluid pressure responsive member. Because the porting is responsive to the pressure differential between the two lines, the changeover of the porting is automatic upon the reversal of the operation of the compressor.

5 Claims, 7 Drawing Figures

REVERSIBLE ROTATING VANE ROTARY COMPRESSOR HAVING A MOVABLE SUPPLEMENTAL SUCTION PORT

BACKGROUND OF THE INVENTION

In heat pump applications, the switchover from the heating to the cooling mode, and vice versa, reverses the direction of flow for the refrigerant such that the coils serving as the condenser and evaporator, respectively, reverse functions. Where the compressor operates in a single direction, the change in the direction of the flow is generally achieved through a valving arrangement located externally of the compressor. If the compressor itself is reversible, it can be selectively run in either direction to, thereby, achieve the desired direction of flow. The simple reversal of the motor is not, in and of itself, sufficient to produce a compressor with satisfactory performance in both directions. This unequal performance in both directions is due to the switching between high and low side compressor operation, the changes in the cooling requirements and the cooling flow, the reversal of porting function and direction of opening/closing, etc.

SUMMARY OF THE INVENTION

In a rotary hermetic compressor of the valveless rotating vane type driven by a reversible motor, the reversing of the motor direction causes the shifting of the port controlling structure. Specifically, a port controlling member is responsive to the pressure differential between the two lines connected to the shell of the compressor and shifts in accordance with the direction of the pressure differential. Thus, the reversal of the motor reverses the compressor and, thereby, the direction of the pressure differential which, in turn, causes the shifting of the port controlling structure in order to permit the higher volumetric flows required at the suction side of the compressor.

It is an object of this invention to provide a mechanism to enable a reversible, valveless rotating vane rotary compressor to efficiently deliver reverse flow by reversing the direction of motor rotation.

It is a further object of this invention to replace the four-way valve used in heat pump systems for reversing the flow direction.

It is an additional object of this invention to improve system performance in valveless single discharge rotating vane rotary compressors used in heat pump applications.

It is another object of this invention to provide supplemental suction ports in both directions of operation for a reversible compressor. These objects, and others as will become apparent hereinafter, are accomplished by the present invention.

Basically, the reversal of the direction of rotation of a motor driving a compressor reverses the operation of the compressor and, thereby, the direction of the pressure differential across the compressor. The pressure differential acts on a fluid pressure responsive device which shifts in accordance with the direction of the pressure differential. The shifting of the fluid pressure responsive device causes a supplemental suction port to be connected with the suction side of the compressor, whereby, the greater suction volumetric flow can be accommodated.

BRIEF DESCRIPTION OF THE DRAWINGS

For a fuller understanding of the present invention, reference should now be made to the following detailed description, thereof, taken in conjunction with the accompanying drawings wherein.

DESCRIPTION OF THE PREFERRED EMBODIMENT

Figure 1:
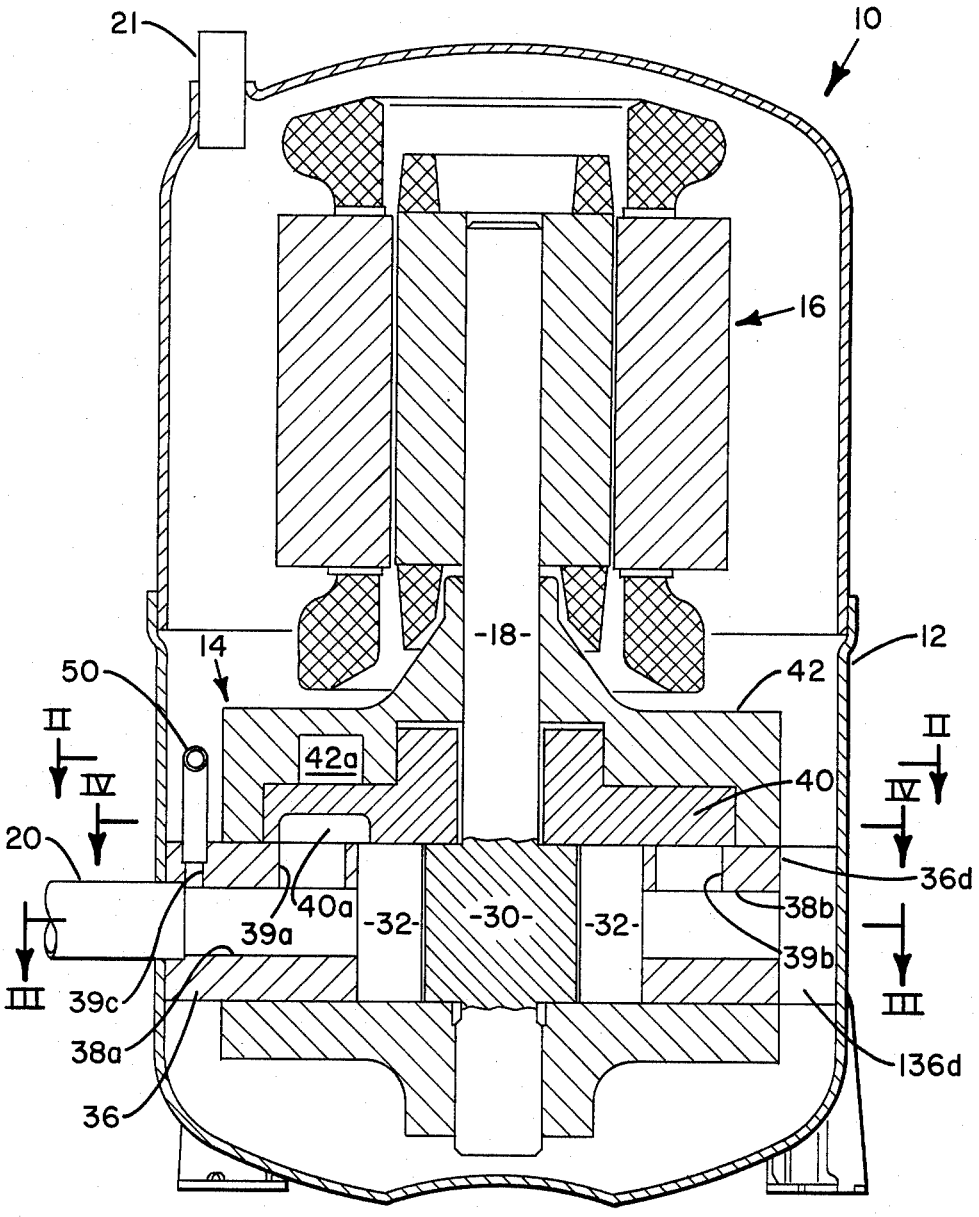
FIG. 1 is a sectional view of the motor-compressor unit of the present invention taken along line I—I of FIG. 3.
Figure 2:
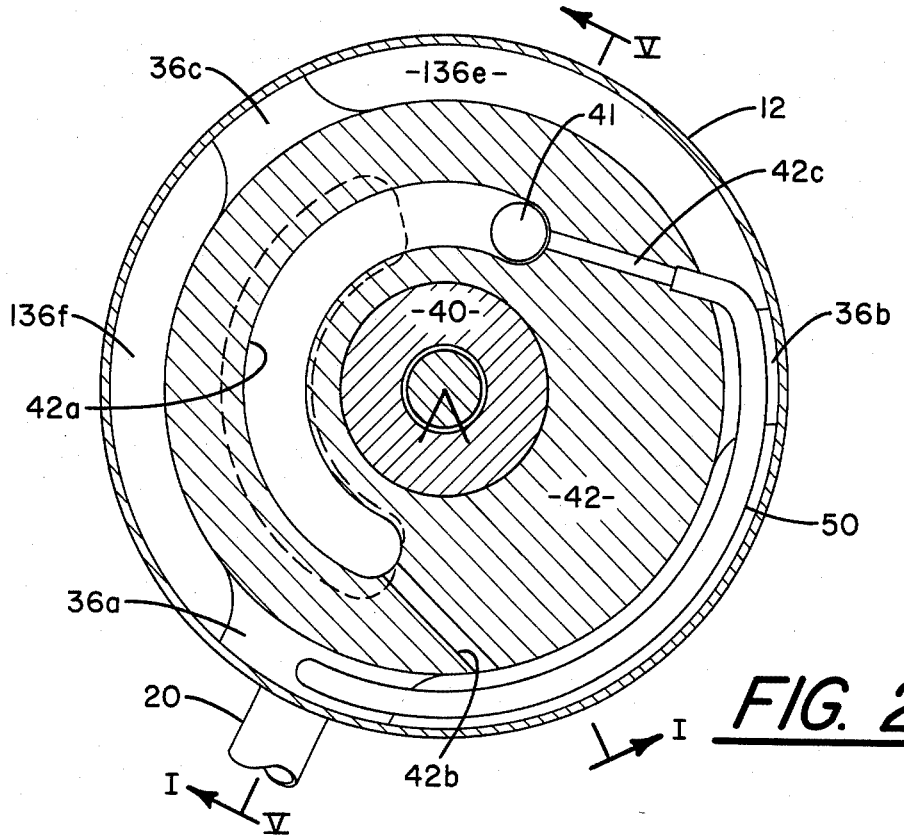
FIG. 2 is a sectional view taken along line II—II of FIG. 1 showing the position of the members during clockwise rotation of the motor.
Figure 3:
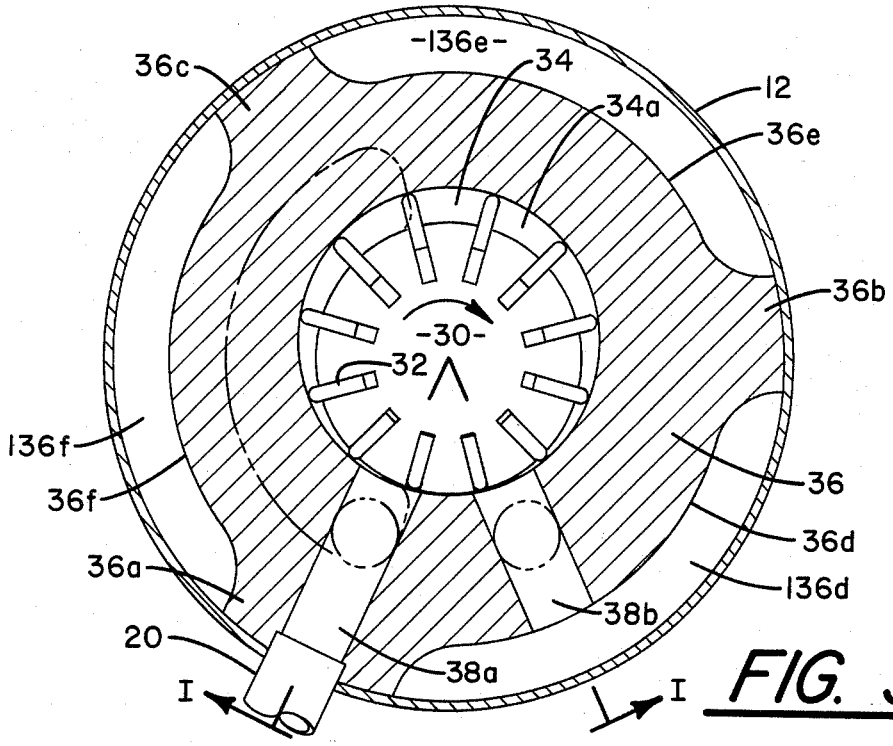
FIG. 3 is a sectional view taken along line III—III of FIG. 1 showing the position of the members during clockwise rotation of the motor.
Figure 4:
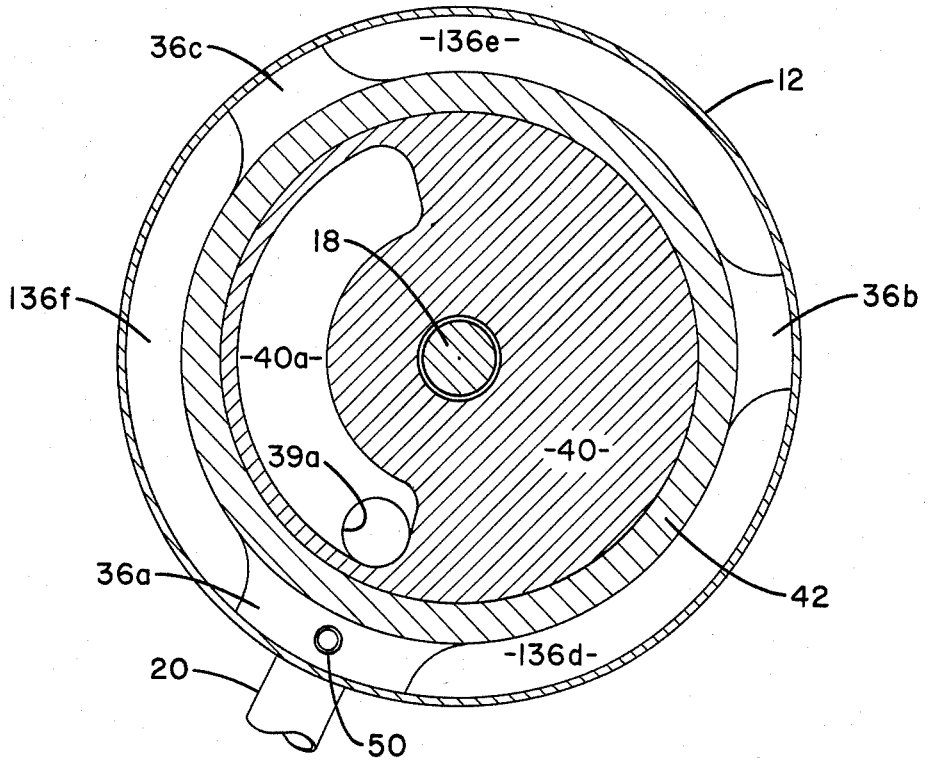
FIG. 4 is a sectional view taken along line IV—IV of FIG. 1 showing the position of the members during clockwise rotation of the motor.

In the Figures, the numeral 10 generally designates a hermetic motor-compressor unit having a shell 12. Fluid communication with the compressor 14 is provided by lines 20 and 21. The compressor 14 is reversibly driven by reversible motor 16 which is connected to compressor 14 via shaft 18. Motor 16 can be any conventional reversible motor suitable for use in a hermetic compressor. Shaft 18 is connected to and rotatably drives cylindrical vane support 30 in walled, offset circular chamber 34 in block 36. Vane support 30 contains a plurality of reciprocably moving, radially extending vanes 32 which are biased outwardly into contact with the wall defining cylindrical chamber 34 by centrifugal force derived from the rotation of the shaft 18 to define a plurality of trapped volumes **34*a* between adjacent vanes 32. If necessary or desirable, springs may be used for biasing each vane 32 to get sufficient and balanced biasing forces. As is best shown in FIGS. 2–4, block 36 is in touching contact with the interior of shell 12 at the portions labeled 36*a–c*. Additionally, block 36 has a number of cutouts labeled 36*d–f* which define plenums 136*d–f*, respectively, in combination with the interior of shell 12. Two horizontal bores, 38*a* and *b*, are located within block 36 with bore 38*a* being in direct fluid communication with line 20, and bore 38*b* being in direct fluid communication with plenum 136. As best shown in FIG. 1, there are three axially or vertically extending bores 39*a–c* with bores 39*a* and *c* being in direct fluid communication with bore 38*a* and bore 39*b* being in direct fluid communication with bore 38*b***.

Figure 5:
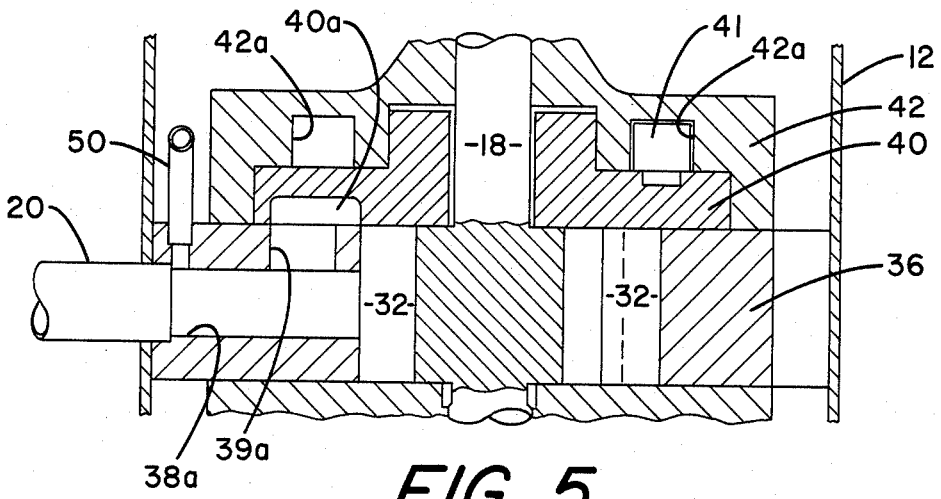
FIG. 5 is a partial sectional view taken along line V—V of FIG. 2.

Overlying and contacting block 36 are disk 40 and cover 42 with disk 40 being rotatably located within cover 42. Cover 42 is fixedly secured to block 36 by any suitable conventional means such as bolts (not illustrated). As best shown in FIG. 2, an arcuate recess **42*a* is formed in cover 42 and is fluidly connected to plenum 136*d* via passage or line 42*b*. Arcuate recess 42*a* is, additionally, in fluid communication with line 20 via passage or line 42*c*, line 50 and bore 39*c*. As best seen in FIG. 4, disk 40 has an arcuate recess which defines a supplemental suction port. Referring to FIGS. 2 and 5, disk 40 also has an axially extending cylindrical knob 41 which is movable in arcuate recess 42***a* responsive to the differential in pressure between that supplied by line 42*b* and that supplied by line 42*c*. Thus, knob 41 is effectively a piston and recess 42*a* a piston chamber. Because knob 41 acts as a piston, fluid leakage between lines 42*b* and *c* should be minimized to maintain compressor efficiency and maintain a pressure differential across knob 41. However, knob 41 must be free enough to move due to the pressure differential thereacross. Line 20 is in communication with recess 42*a* and knob 41 via bores 38*a* and 39*c*, and lines 50 and 42*c*. Line 21 is in communication with recess 42*a* and knob 41 via the plenum defined by shell 12, plenum 136*d* and line 42*b*.

Referring now to FIGS. 1–5 where shaft 18, cylindrical vane support 30 and vanes 32 are being rotated in a clockwise direction as illustrated, line 20 is the suction line and line 21 is the discharge line. Refrigerant at suction pressure is supplied to compressor 14 via line 20. Specifically, refrigerant at suction pressure is supplied directly from line 20 to chamber 34 via bore 38*a*. Additionally, refrigerant at suction pressure is supplied from bore 38*a* via bore 39*a* and the recess 40*a* to chamber 34. Refrigerant in bore 38*a* is in fluid communication with knob 41 and recess 42*a* via bore 39*c* and lines 50 and 42*c*. Thus, bore 38*a* is a primary suction port for chamber 34 and recess 40*a* is a secondary suction port. Refrigerant gas supplied via bore 38*a* and recess 40*a* is compressed and discharged from chamber 34 via bore 38*b*. As is best shown in FIG. 1, bore 38*b* discharges into plenum 136*d*. Plenum 136*d* communicates with the discharge chamber defined by shell 12, when motor 16 is rotating clockwise, and thence to line 21 which is the discharge line. Additionally, the discharge pressure is supplied from the discharge chamber defined by shell 12 to plenum 136*d* from which it is supplied to recess 42*a* via line 42*b* where it acts upon knob 41 in opposition to the fluid pressure supplied via line 42*c*. Since the discharge pressure acting on knob 41 is greater than the suction pressure acting on knob 41, disk 40 is shifted to the FIG. 2 position when the motor is rotated clockwise. It will be noted, that when disk 40 is in the FIG. 2 position, bore 39*b* is blocked and serves no purpose.

Figure 6:
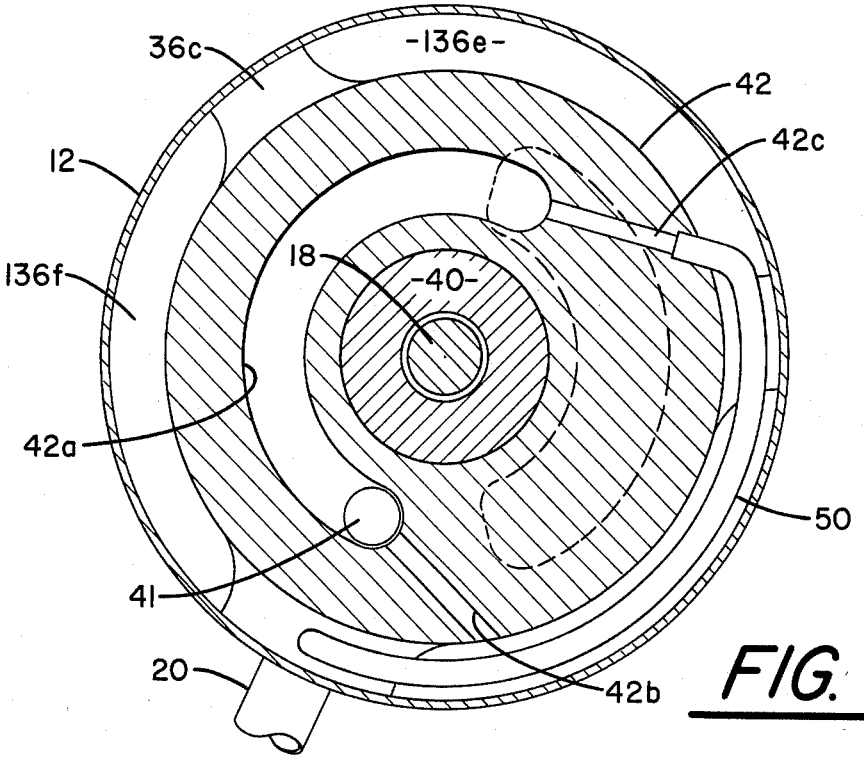
FIG. 6 is a sectional view corresponding to FIG. 2 for counterclockwise rotation of the motor.
Figure 7:
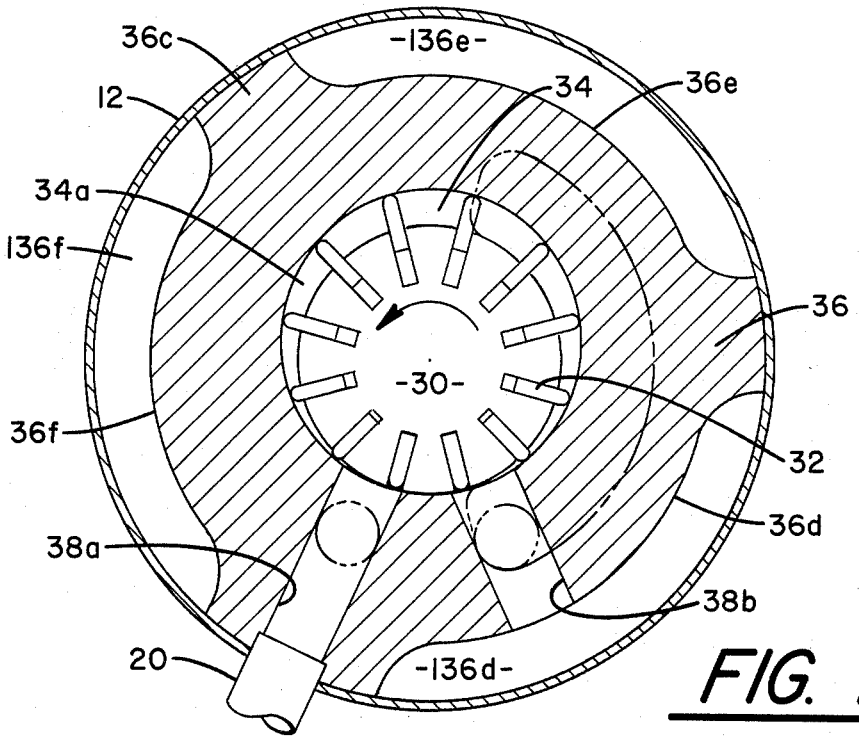
FIG. 7 is a sectional view corresponding to FIG. 3 for counterclockwise rotation of the motor.

If the motor 16 is rotated counterclockwise, line 21 becomes the suction line, shell 12 defines a suction plenum and line 20 is the discharge line. Assuming that the motor 16 had been running in a clockwise direction so that disk 40 is in the FIG. 2 position, all of the porting will be the reverse of that previously described and recess 40*a* will be initially acting as a secondary discharge port. Since the volumetric flow is much greater on the suction side than on the discharge side, the operation will be inefficient until disk 40 shifts from the FIG. 2 to the FIG. 6 position. Refrigerant at discharge pressure is supplied from bore 38*a* via bore 39*c* and lines 50 and 42*c* to recess 42*a* where it acts on knob 41. Refrigerant at suction pressure which is supplied via line 21 to the suction plenum defined by shell 12 is supplied via plenum 136*d* and line 42*b* to recess 42*a* where it acts on knob 41 in opposition to the discharge pressure. When the discharge pressure builds up sufficiently, disk 42 is shifted from the FIG. 2 to the FIG. 6 position due to the pressure differential across knob 41. In the FIG. 6 position, recess 40*a* is in fluid communication with bore 39*b*, while bore 39*a* is now blocked and serves no purpose. With motor 16 running counterclockwise and disk 42 in the FIG. 6 position, refrigerant at suction pressure is supplied via line 21 to the suction plenum defined by shell 12. From the suction plenum defined by shell 12, the refrigerant passes between shell 12 and cover 42 and block 36 to plenum 136*d* where it passes via bore 38*b* into cylindrical chamber 34. Additionally, it passes from bore 38*b* via bore 39*b* into recess 40*a* which acts as a secondary suction port in fluid communication with chamber 34. Refrigerant at discharge pressure is discharged from chamber 34 via bore 38*a*. Bore 38*a* is in direct fluid communication with line 20.

From the foregoing, it should be clear that disk 40 is rotated and the porting changed in response to the pressure differential between lines 20 and 21 which acts on the knob 41. This rotation of disk 40 is responsive to the changing of the direction of rotation of motor 16 which reverses the suction and discharge lines and takes place automatically upon the reversal of the motor.

Although a preferred embodiment of the present invention has been illustrated and described, other changes will occur to those skilled in the art. It is, therefore, intended that the present invention is to be limited only by the scope of the appended claims.

What is claimed is:

1. A reversible hermetic compressor unit comprising:

shell means having first and second lines connected thereto;

rotary compressor means within said shell means;

motor means within said shell means for selectively driving said rotary compressor means in a clockwise or a counterclockwise direction;

said rotary compressor means including:

a compressor chamber with a rotating vane rotor therein;

a first fluid passage means fluidly connected to said first line and said compressor chamber;

a second first passage means fluidly connected to said second fluid line and said compressor chamber;

a third fluid passage means fluidly connected to said first fluid passage means;

a fourth fluid passage means fluidly connected to said second fluid passage means; and means movable in response to the pressure differential between said first and second lines to position a supplemental suction port in communication with either said first fluid passage means via said third fluid passage means or said second fluid passage means via said fourth fluid passage means and said chamber according to which of said first and second fluid passage means is the suction line as determined by the direction in which said motor means drives said rotary compressor means.

2. The reversible hermetic compressor unit of claim 1 wherein said means movable in response to the pressure differential between said first and second lines is a disk means including an axially extending cylindrical member which is received in an arcuate chamber and which is opposedly acted on by fluid pressure from said first and second fluid lines whereby the differential pressure acting on said cylindrical member causes the movement of said disk means to position said supplemental suction port in communication with either said first or second fluid passage means and said chamber according to which of said first and second fluid passage means is the suction line as determined by the direction of said pressure differential.

3. A reversible hermetic compressor unit comprising:

(I) shell means having a first and second fluid line connected thereto with said second fluid line connected to the interior of said shell means which defines a plenum;

(II) rotary compressor means within said shell means including:

(a) a block having a walled opening therein defining a compressor chamber;

(b) a rotatable vane support within said chamber having a plurality of vanes coacting with said walls of said walled opening to define a plurality of trapped volumes;

(c) a first bore in said block connecting said first fluid line to said chamber;

(d) a second bore connecting said plenum defined by said shell means with said chamber;

(e) a third bore intersecting and in fluid communication with said first bore;

(f) a fourth bore intersecting and in fluid communication with said second bore;

(g) disk means movable between first and second positions responsive to the direction of the pressure differential between said first line and said plenum defined by said shell means and in said first position, when said first bore in serving as the suction line, connecting said third bore to said chamber as a supplemental suction port and in said second position, when said second bore is serving as the suction line, connecting said fourth bore to said chamber as a supplemental suction port;

(III) motor means within said shell means for selectively driving said rotary compressor means in a clockwise direction or a counterclockwise direction whereby the direction of rotation of said motor means determines which of said first and second fluid lines is the suction line and which is the discharge line and responsive to the resulting difference in pressure between the suction line and the discharge line causes the positioning of said disk means and thereby provides fluid communication to said chamber via either said third or fourth bore which serves as the supplemental suction port.

4. The reversible hermetic compressor unit of claim 3 wherein said disk means includes an axially extending member which is received in an arcuate chamber and which is opposedly acted on by fluid pressure from said first fluid line and from said plenum defined by said shell means which is in fluid communication with said second fluid line whereby the differential in pressure acting on said axially extending member causes the movement of said disk means between said first and second positions.

5. The reversible compressor unit of claim 4 wherein said disk means further includes an arcuate recess which provides the connection between said third bore and said chamber in said first position of said disk means and which provides the connection between said fourth bore and said chamber in said second position of said disk means.

* * * * *